US011562650B2

(12) United States Patent
Zhao et al.

(10) Patent No.: US 11,562,650 B2
(45) Date of Patent: Jan. 24, 2023

(54) METHOD FOR BERTH ALLOCATION OF A MULTILINE BUS STATION AND SPEED GUIDANCE OF BUSES

(71) Applicant: CHANG'AN UNIVERSITY, ShaanXi (CN)

(72) Inventors: Xiangmo Zhao, ShaanXi (CN); Kang Sun, ShaanXi (CN); Siyuan Gong, ShaanXi (CN); Xia Wu, ShaanXi (CN); Yukun Ding, ShaanXi (CN); Jialin Liu, ShaanXi (CN); Xinyi Li, ShaanXi (CN); Lu Zhao, ShaanXi (CN); Yalong Wu, ShaanXi (CN); Fenglin Liu, ShaanXi (CN)

(73) Assignee: CHANG'AN UNIVERSITY, Xi'an (CN)

( * ) Notice: Subject to any disclaimer, the term of this patent is extended or adjusted under 35 U.S.C. 154(b) by 116 days.

(21) Appl. No.: 17/134,455

(22) Filed: Dec. 27, 2020

(65) Prior Publication Data

US 2022/0013011 A1 Jan. 13, 2022

(51) Int. Cl.

| | |
|---|---|
| ***G08G 1/123*** | (2006.01) |
| ***G08G 1/127*** | (2006.01) |
| ***G08G 1/133*** | (2006.01) |
| ***G08G 1/0968*** | (2006.01) |
| ***G08G 1/14*** | (2006.01) |

(52) U.S. Cl.

CPC ..... *G08G 1/133* (2013.01); *G08G 1/096872* (2013.01); *G08G 1/123* (2013.01); *G08G 1/127* (2013.01); *G08G 1/143* (2013.01)

(58) Field of Classification Search

None

See application file for complete search history.

(56) References Cited

U.S. PATENT DOCUMENTS

| | | | | |
|---|---|---|---|---|
| 10,884,431 | B2 * | 1/2021 | Dickens | G05D 1/0291 |
| 2003/0014166 | A1 * | 1/2003 | Chinigo | B60R 21/01512 340/433 |
| 2015/0294430 | A1 * | 10/2015 | Huang | G06Q 50/26 701/2 |
| 2016/0055744 | A1 * | 2/2016 | Branson | G08G 1/0112 340/916 |

FOREIGN PATENT DOCUMENTS

| | | | |
|---|---|---|---|
| CN | 204650771 | U | 9/2015 |
| CN | 106297372 | A | 1/2017 |
| CN | 110211406 | A | 9/2019 |

* cited by examiner

*Primary Examiner* — John F Mortell

(57) ABSTRACT

Provided is a method for berth allocation of a multiline bus station and speed guidance of buses. The intelligent control center sorts all buses between the current station and the previous station to form the BusNumber table, and performs speed guidance for all buses in the BusNumber table. Whether the guided bus can pass through the signalized intersection is determined. The buses that cannot pass through the signalized intersection are guided by acceleration, and those that cannot pass through the signalized intersection by acceleration guidance method update their speeds based on the phase state of signal light, so as to pass through the signalized intersection without stopping in most cases. All buses are conducted through speed guidance methods, and the berths are allocated for all the buses under different conditions.

9 Claims, 4 Drawing Sheets

METHOD FOR BERTH ALLOCATION OF A MULTILINE BUS STATION AND SPEED GUIDANCE OF BUSES

CROSS-REFERENCE TO RELATED APPLICATIONS

This application claims the benefit of priority from Chinese Patent Application No. 202010652716.5, filed on Jul. 8, 2020. The content of the aforementioned application, including any intervening amendments thereto, is incorporated herein by reference in its entirety.

TECHNICAL FIELD

The present application relates to public transportation, and more particularly to a method for berth allocation of a multiline bus station and speed guidance of buses.

BACKGROUND

Due to the accelerated urbanization process, urban population rapidly expands, and the number of urban vehicles continuously increases, which not only causes serious traffic congestion, but also increases air pollution such as smog. At present, major cities have implemented mandatory policies such as purchase restrictions, license restrictions and number restrictions. At the same time, the public transportation is greatly enhanced.

Generally, residents take the public transportation as the main travelling way. Since the public transportation has large passenger capacity and occupies less road resources, it is considered as an important measure to ease urban traffic congestion. The bus stations are a main part of public transportation, and play an important role in the public transportation network. The operational efficiency of the bus stations affects the service quality of the whole public transportation to a certain extent. However, there are still various problems of urban bus stations. At present, bus lines generally have covered most areas of city to meet the needs of high passenger flow volume. However, the bus stations cannot effectively guide the buses and passengers, and thus the whole transportation line fails to operate efficiently and orderly. Specifically, on the one hand, the bus stations cannot predict the information of upcoming buses, and passengers blindly and disorderly wait for the bus. Bus drivers may frequently start and stop the bus or even not park at the stop station due to the confusion of passengers. On the other hand, a bus station is usually designed for multiple lines, and when the dispatching center cannot dispatch buses in an orderly manner, buses may line up in the bus station. In this way, passengers are unable to take the bus in an orderly manner, and local traffic congestion occurs.

Some scholars have researched on how to effectively improve the service level of the bus stations. Currently, there are two ways to achieve the object. One is to make a rough berth allocation for the buses to be parked, and the other is to obtain the bus information by setting detection points near the station for the berth allocation. However, the above two ways still have shortcomings. For example, in the case of limited urban road resources, most bus stations are straight lines that are integrated with the road, rather than harbor-shaped stations. Under this condition, the buses must enter the station one by one, and the overtaking is almost impossible, in which the first way cannot fully and effectively utilize the vacant berths on the station. The second way is to sort the arrival orders according to the time when the buses enter the guidance area, but it is difficult to deal with the problem of inconsistent driving time in different directions caused by complicated traffic conditions. In addition, although the upcoming buses can accurately obtain detailed information of the upcoming buses, buses of different lines may enter the station at the same time since the berth state and the service time of parked buses are not taken into consideration. For the station with limited berths, buses cannot be effectively allocated with berths and may line up in the bus station.

SUMMARY

The present disclosure aims to provide a method for berth allocation of a multiline bus station and speed guidance of buses, to solve the following problems to improve the time-space utilization rate of the berths of the bus station. In the prior art, when buses of different lines enter the bus station at the same time, passengers chase the buses on the station, the local traffic congestion and the second start and stop of buses may happen.

Technical solutions of this application are described as follows.

The present application provides a method for berth allocation of a multiline bus station and speed guidance of buses, comprising:

S1: ranking an estimated remaining arrival time of buses between a current station and a previous station in an ascending order to form a BusNumber table;

S2: conducting speed guidance for current upcoming bus in the BusNumber table through a bus-mounted terminal, and an allocating berth for the current upcoming bus through an intelligent control center;

S3: determining whether the current upcoming bus is allowed to pass through a signalized intersection; if yes, proceeding to S4; otherwise, proceeding to S5;

S4: conducting the speed guidance of the step 2 for the current upcoming bus; maintaining the bus sequence in the BusNumber table through the intelligent control center; and allocating the berth determined in step 2 for the current upcoming bus; and then proceeding to S11;

S5: determining whether a sequence number of the current upcoming bus is the first in the BusNumber table and whether the current upcoming bus is able to pass through the signalized intersection through acceleration; if yes, proceeding to S6; otherwise, proceeding to S7;

S6: after the current upcoming bus accelerates to pass through the signalized intersection, guiding the current upcoming bus to enter a waiting area of the multiline bus station with a fixed guidance method, and allocating the berth determined in the step 2 for the current upcoming bus; and proceeding to S11;

S7: updating, by the bus-mounted terminal of the current upcoming bus, the speed guidance to allow the current upcoming bus to pass through the signalized intersection without stopping; and then determining the speed guidance after passing through the signalized intersection; and proceeding to S8;

S8: determining whether estimated remaining arrival time of the current upcoming bus is greater than that of a subsequent bus in the BusNumber table and whether the current upcoming bus and the subsequent bus in the BusNumber table are in the same direction; if yes, proceeding to S9; otherwise, proceeding to S10;

S9: exchanging the sequence of the current upcoming bus and the subsequent bus in the BusNumber table to update the BusNumber table; and then proceeding to S2;

S10: based on the updated speed guidance in the step 7 and current berth occupancy information, reallocating the berth for the current upcoming bus; and then proceeding to S11;

S11: determining whether the sequence of the current upcoming bus is at the end of the BusNumber table; if yes, proceeding to S12; otherwise, determining the sequence of the subsequent bus following the current upcoming bus in the BusNumber table, and then proceeding to S2; and S12: determining the sequence of the buses in the BusNumber table, and guiding actual speeds of the buses based on the speed guidance in the BusNumber table.

In an embodiment, the step 2 comprises:

determining whether the sequence number of the current upcoming bus is the first in the BusNumber table;

if yes, conducting the speed guidance for the current upcoming bus based on the berth occupancy state and the distance between the current upcoming bus and the multiline bus station received by the bus-mounted terminal, and allocating the berth for the current upcoming bus by the intelligent control center; and then proceeding to S3;

otherwise, conducting the speed guidance for the current upcoming bus based on threshold guidance time of the current upcoming bus, berth allocation information and the distance between the current upcoming bus and the station, and allocating the berth for the current upcoming bus by the intelligent control center; and then proceeding to S3.

In an embodiment, if the sequence number of the current upcoming bus is not the first in the BusNumber table, the step 2 comprises:

SS1: determining whether a sum of estimated remaining arrival time $T_{rem}'$ of a previous upcoming bus and a total service time $T_{pg}'$ of the previous upcoming bus is less than or equal to estimated remaining arrival time $T_{rem}$ of the current upcoming bus; if yes, proceeding to SS2; otherwise, proceeding to SS3;

SS2: allocating the current upcoming bus to the berth allocated for the previous upcoming bus by the intelligent control center; taking the sum of the estimated remaining arrival time $T_{rem}'$ of the previous upcoming bus and the total service time $T_p'$ of the previous upcoming bus at the multiline bus station as the threshold guidance time $T_g$ of the current upcoming bus, so as to determine the speed guidance of the current upcoming bus; and then proceeding to SS6;

SS3: determining, by the bus-mounted terminal, whether there is an available berth behind the berth allocated for the previous upcoming bus; if yes, proceeding to SS4; otherwise, proceeding to SS5;

SS4: allocating, by the intelligent control center, the berth behind the berth allocated for the previous upcoming bus for the current upcoming bus; taking the sum of the estimated remaining arrival time $T_{rem}'$ of the previous upcoming bus and the deceleration time $T_{de}'$ that the previous upcoming bus takes for stopping in the multiline bus station as the threshold guidance time $T_g$, so as to determine the speed guidance of the current upcoming bus; and then proceeding to SS6;

SS5: allocating the current upcoming bus to No. 1 berth by the intelligent control center; taking the sum of the estimated remaining arrival time $T_{rem}'$ of the previous upcoming bus and the total service time $T_{pg}'$ of the previous upcoming bus as the threshold guidance time $T_g$, so as to determine the speed guidance of the current bus-mounted terminal; and then proceeding to SS6; and SS6: updating the estimated remaining arrival time $T_{rem}$ of the current upcoming bus to obtain updated estimated remaining arrival time $T_{rem}^*$ of the current upcoming bus, and sending it to the intelligent control center in real time.

In an embodiment, if the sequence number of the current upcoming bus is the first in the BusNumber table, the method comprises:

SSS1: determining, by the intelligent control center, whether there is an available berth at the multiline bus station; if yes, proceeding to SSS3; otherwise, proceeding to SSS2;

SSS2: taking parking service time $T_{pg}$ of a parked bus as the threshold guidance time $T_g$ of the current upcoming bus; determining the speed guidance of the current upcoming bus based on the distance between the current upcoming bus and the multiline bus station; at the same time, allocating the current upcoming bus to No. 1 berth by the intelligent control center; and proceeding to SSS8;

SSS3: determining, by the bus-mounted terminal, whether the number of the available berth of the multiline bus station is greater than 1; if yes, proceeding to SSS4; otherwise, proceeding to SSS5;

SSS4: allocating, by the intelligent control center, the current upcoming bus to the berth behind a last occupied berth, and sending allocation information to the bus-mounted terminal; and selecting, by the bus-mounted terminal, a quickest acceleration guidance method to guide a speed of the current upcoming bus according to the allocation information; and then proceeding to SSS8;

SSS5: determining, by the intelligent control center, whether the parking service time $T_{pd}$ of the parked bus is greater than the sum of the threshold guidance time $T_g$ required for the current upcoming bus to arrive at the multiline bus station with an accelerated guidance and estimated parking service time $T_{pg}$ of the current upcoming bus at the multiline bus station; if yes, proceeding to SSS6; otherwise, proceeding to SSS7;

SSS6: allocating, by the intelligent control center, the current upcoming bus to the berth at the end of the station; and sending the allocation information to the bus-mounted terminal; selecting the quickest acceleration guidance method to guide the speed of the current upcoming bus according to the allocation information, and proceeding to SSS8;

SSS7: allocating, by the intelligent control center, the current upcoming bus to the No. 1 berth in the multiline bus station, and sending the allocation information to the bus-mounted terminal; taking the parking service time $T_{pd}$ of the parked bus as the threshold guidance time $T_g$ of the current upcoming bus, so as to determine the speed guidance of the current upcoming bus; and then proceeding to SSS8; and SSS8: updating the estimated remaining arrival time $T_{rem}$ of the current upcoming bus to obtain updated estimated remaining arrival time $T_{rem}^*$ of the current upcoming bus and sending it to the intelligent control center.

In an embodiment, the step 3 comprises:

determining the speed guidance of the current upcoming bus is uniform deceleration guidance, uniform speed guidance or uniform acceleration guidance according to the speed guidance determined in the step 2; and calculating the time $T_{gs}$ that the current upcoming bus takes from the current position to the signalized intersection; and at the same time, obtaining, by the intelligent control center, a phase state of a signal light of the signalized intersection;

if the $\mathrm{mod}(T_{gs},T_i)\leq T_{gi}$ or $\mathrm{mod}(T_{gs},T_i)\geq T_{ri}$, enabling the current upcoming bus to pass the signalized intersection from the current position within a countdown of a current signal light according to the speed guidance determined in the step 2, wherein $T_{gi}$ is the countdown of a current green light of a signal light; $T_{ri}$ is the countdown of a current red light of the signal light; $T_i$ is the total cycle of the signal light; $r_i+g_i=T_{gi}$; wherein $r_i$ is the cycle of the red light of the signal light, and $g_i$ is the cycle of the green light of the signal light.

In an embodiment, in the step 3, in the case that the speed guidance determined the step 2 fails to guide the current upcoming bus to pass the signalized intersection, 1) if $\mathrm{mod}(T_{gs},T_i)>T_{gi}$, the current upcoming bus fails to pass the signalized intersection within the countdown of the current green light of the light signal, and delay time $T_d=r_i-[\mathrm{mod}(T_{gs},T_i)-T_{gi}]$ of the current upcoming bus is caused, wherein the delay time $T_d$ is caused by the signal light; and 2) if $\mathrm{mod}(T_{gs},T_i)<T_{ri}$, the current upcoming bus fails to pass the signalized intersection within the countdown of the current red light of the light signal, and the delay time $T_d=T_{ri}-\mathrm{mod}(T_{gs},T_i)$ is caused.

In an embodiment, in the step 7, when the current upcoming bus passes the signalized intersection without stopping, time $T_{gs}$ that the current upcoming bus needs to take from the current position to the signalized intersection is updated to an actual time $T_{gs}'$ that the current upcoming bus takes from the current position to the signalized intersection; and $T_{gs}'=T_{gs}+T_d$, wherein $T_d$ is the delay time caused by the signal light.

In an embodiment, the method further comprises:

S13: determining whether the current guidance environment is changed; if yes, returning to the step 1; otherwise, proceeding to S14;

S14: maintaining the current guidance to guide the speed of all buses in the BusNumber table; deleting the bus that has been guided from the BusNumber table; and enabling the sequence of unguided buses to move forward one by one; and proceeding to S15; and S15: determining, by the intelligent control center, whether all buses in the BusNumber table have been guided, if yes, completing the speed guidance for all upcoming buses within a current detectable range; otherwise, returning to the step 12 to perform the speed guidance for the remaining buses in the BusNumber table.

In an embodiment, the method further comprises:

S16: sending, by the intelligent control center, the berth allocation information to the bus-mounted terminal and a station terminal;

performing a voice prompt and dynamic display after the bus-mounted terminal and the station terminal receive the berth allocation information; and updating, by the intelligent control center, berth state information of the station, and transmitting the berth state information of the multiline bus station to the station terminal.

Compared to the prior art, the present disclosure has at least the following beneficial effects.

The present invention provides a method for berth allocation of a multiline bus station and speed guidance of buses, which combines the kinematics laws of the bus with the real-time state information of the buses and phase state of the signal light to sort all upcoming buses entering the area to be guided in the order of arrival. The berth occupancy state and pre-allocation state of the stations are considered on the basis of the order to realize the planning of the speed guidance method and berth allocation of all buses under the conditions that the station is full or not full. When planning the speed guidance, the threshold guidance time is combined with the parking state of the station and the distance between the bus and the station are considered to determine the specific speed guidance method and berth pre-allocation. At the same time, in view of the delay caused by the signal lights, the guidance time needs to be updated and the speed guidance method needs to be re-planned under the delay. After the planning is completed, the changes of the real-time traffic environment are also considered in the process of implementing the speed guidance to further realize the update and new round of planning of the sequence of the upcoming bus.

Furthermore, the present invention takes into account the state that the station is full or not full to realize the speed planning and berth allocation for the multiline buses. In the full state, the parking service time of buses at the station is considered, within which the speed guidance method of the upcoming bus is implanted to pull in the bus without parking. In the state that the station is not full, the occupancy state and pre-allocation of the station berths and the space-time utilization of the station is fully considered to determine the optimal speed guidance method and berth allocation. On the one hand, the method of the present invention can effectively guide the operation of buses, provide a useful reference for driver's driving decision and avoid the occurrence of station clusters and local road congestion, thereby improving fuel economy and operating efficiency of bus route. On the other hand, the advance prediction of the upcoming bus is provided for the passengers, which is contributed to regulating the orderly boarding of the passengers on the station, and improving the capacity of the bus station and the level of public transportation service.

DETAILED DESCRIPTION OF EMBODIMENTS

The present disclosure will be further described below with reference to the accompanying drawings and specific embodiments.

Figure 1:
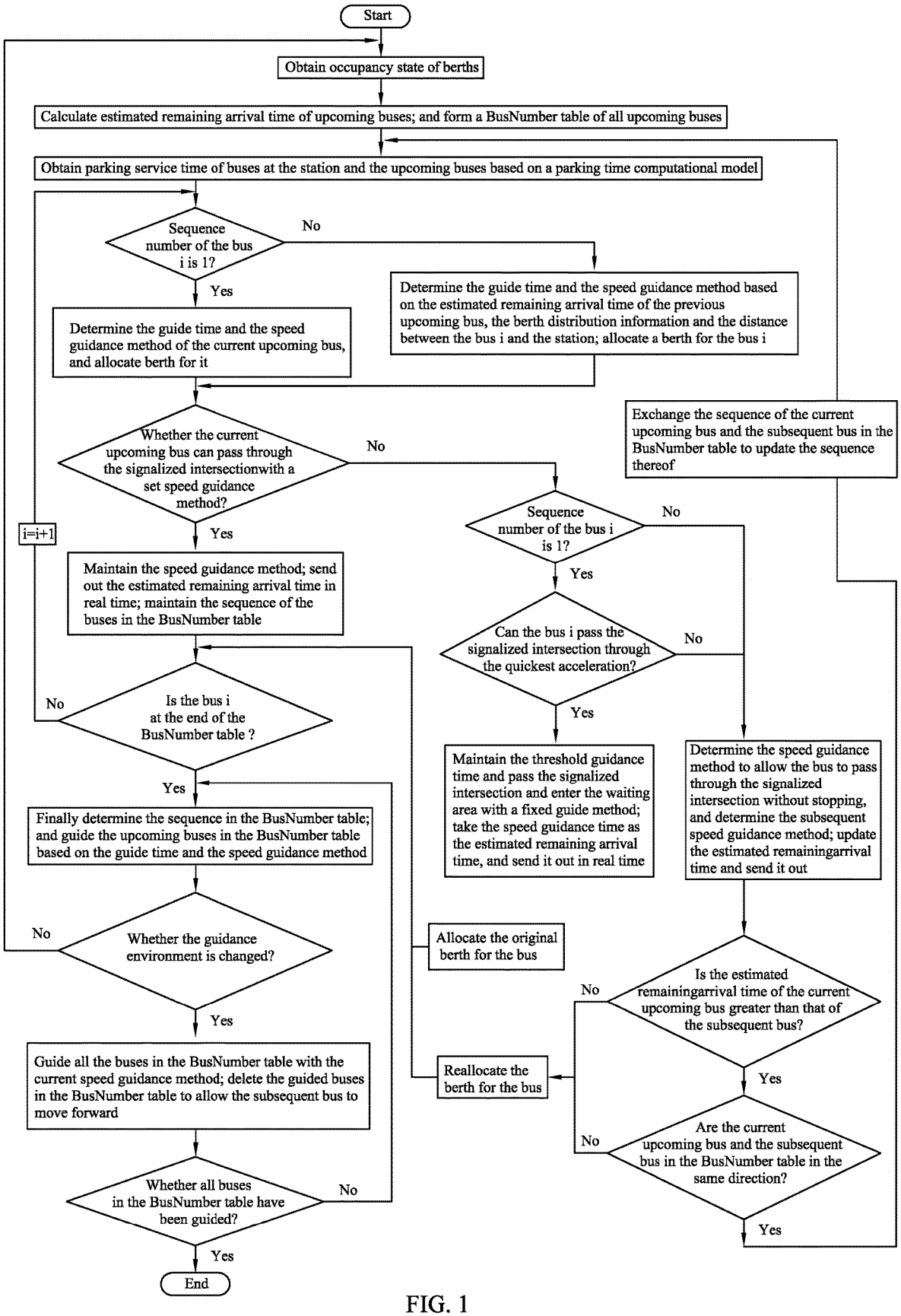
FIG. 1 is a flow chart of a method for berth allocation of a multiline bus station and speed guidance of buses according to an embodiment of the present disclosure.

As shown in FIG. 1, provided is a method for berth allocation of a multiline bus station and speed guidance of buses, including the following steps.

S1: For a bus station, a storage module of the bus station stores berth state information (including the number of vacant berths and an occupancy state of each berth) of the bus station in real time to form a record chart of berth state, and then the storage module sends the berth state information to an intelligent control center through a wireless communication module, and the intelligent control center sends out the berth state information of the bus station in real time.

S2: Each bus sends running state information, such as position and speed, to the intelligent control center through a bus-mounted wireless communication module. After receiving the running state information through the wireless communication module, the intelligent control center calculates estimated remaining arrival time $T_{rem}$ of unguided buses coming to the bus station according to the running state information and a high-precision map. At the same time, based on estimated remaining arrival time $T_{rem}$* of an guided bus, the intelligent control center sorts the estimated remaining arrival time of the unguided buses between the bus station and a previous station in an ascending order to form a sequence of upcoming buses, so as to form a BusNumber table recording sequence numbers of the upcoming buses.

S3: The intelligent control center obtains the parking service time $T_{pd}$ of parked buses and parking time $T_{pg}$ of buses to be parked based on a parking time computational model.

S4: Whether the estimated remaining arrival time of a current upcoming bus is the earliest in the unguided buses is determined; if yes, proceed to S7; otherwise, proceed to S5.

S5: According to the BusNumber table obtained in S2, each bus obtains the estimated remaining arrival time of the previous bus in real time through the bus-mounted wireless communication module, and based on the estimated remaining arrival time of the previous bus, the speed of each bus is determined to determine speed guidance of each bus; and then proceed to S6.

S6: A bus-mounted intelligent terminal of the current upcoming bus conducts the speed guidance for the current upcoming bus according to threshold guidance time of the upcoming bus, berth state information of the bus station and a distance between the current upcoming bus and the bus station. At the same time, the intelligent control center allocates berths for the current upcoming buses, and updates the estimated remaining arrival time of the current upcoming buses and sends it out. Then, proceed to S8 for further determination.

S7: The bus-mounted intelligent terminal conducts the speed guidance for the upcoming buses based on the berth state information of the bus station and the distance between the current upcoming bus and the bus station received by the bus-mounted wireless communication module; the intelligent control center allocates berths for the current upcoming buses, and updates the estimated remaining arrival time of the current upcoming buses and sends it out; and then proceed to S8 for further determination.

S8: Whether the current upcoming bus is allowed to smoothly pass a signalized intersection with such speed guidance is determined; if yes, proceed to S9; otherwise proceed to S10.

S9: The current upcoming bus maintains the speed guidance and updates its estimated remaining arrival time and sends it out; at the same time, the intelligent control center maintains the sequence numbers in the BusNumber table. Then, proceed to S18.

S10: If the current upcoming bus is not allowed to pass the signalized intersection, whether the current upcoming bus is the first in the BusNumber table is determined; if yes, proceed to S11; otherwise, proceed to S13.

S11: Whether the current upcoming bus is able to pass the signalized intersection in the shortest time through the acceleration is determined; if yes, proceed to S12; otherwise, proceed to S13.

S12; The current upcoming bus maintains the threshold guidance time, and the current upcoming bus is guided to pass through the signalized intersection in a shortest period through the acceleration. Then, the current upcoming bus enters a waiting area with a fixed speed guidance method to stop and wait; and the current upcoming bus also updates its estimated remaining arrival time $T_{rem}$* and sends it out in real time. At the same time, the intelligent control center maintains the sequence numbers of the BusNumber table and the original berth allocation of the current upcoming bus, and records the received estimated remaining arrival time $T_{rem}$* in the BusNumber table. Then, proceed to S18.

S13: The bus-mounted intelligent terminal of the current upcoming bus considers the delay caused by signal lights and updates the speed guidance, so that the current upcoming bus can pass the signalized intersection without stopping. Then, the subsequent guidance method is determined according to the state of the current upcoming bus when it reaches the signalized intersection with the updated speed guidance method to reduce a total time delay caused by the signal light. Then, an updated guidance time $T_g$ is determined. The bus-mounted intelligent terminal sends out the updated estimated remaining arrival time in real time. Then, proceed to S14 for further determination.

S14: Whether the estimated remaining arrival time of the current upcoming bus is greater than that of the next upcoming bus in the BusNumber table is determined; if yes, proceed to S15 for further determination; otherwise, proceed to S17.

S15: Whether the current upcoming bus and the next upcoming bus in the BusNumber table are on the way of the same direction; if yes, proceed to S16; otherwise, proceed to S17.

S16; The estimated remaining arrival time of the next upcoming bus is less than that of the previous bus; in the case, the intelligent control center exchanges the sequence numbers of the current upcoming bus and the next upcoming bus to form a new BusNumber table; and then proceed to S3.

S17: Based on the updated guidance time and the current berth allocation state, the intelligent control center re-allocates the berths for the current upcoming buses. The bus-mounted intelligent terminal of the current upcoming bus determines the speed guidance method and sends out its estimated remaining arrival time $T_{rem}$* in real time. The intelligent control center maintains the original sequence in BusNumber table, and records the estimated remaining arrival time $T_{rem}$* in the BusNumber table, and then then proceed to S18.

S18: The intelligent control center determines whether the current upcoming bus is the last bus in the sequence of the current BusNumber table; if yes, proceed to S19; otherwise, the intelligent control center carries out the determination for the next upcoming bus in the BusNumber table. Then, proceed to S4.

S19: The intelligent control center finally determines the sequence of the BusNumber table, and the bus-mounted intelligent terminal of each upcoming bus in the BusNumber table performs the actual speed guidance for each upcoming bus according to the determined speed guidance method. Then proceed to S20 for further determination.

S20: The intelligent control center determines whether the current guidance environment has changed; if yes, proceed to S1 to carry out another round of determination of the sequence in the BusNumber table; otherwise, proceed to S21.

S21: The intelligent vehicle terminals of all buses in the BusNumber table maintain the current speed guidance method. During the guidance process, the guided bus is deleted from the BusNumber table, and sequences of subsequent buses are moved forward one by one, and then proceed to S22.

S22: Whether all buses in the BusNumber table have been guided is determined; if yes, the speed guidance of all upcoming buses within the current detectable range is complete; otherwise, S19 is returned to complete the speed guidance of the remaining buses in the BusNumber table.

In the embodiment, the method also includes the following step.

S23: The intelligent control center sends the berth allocation information of the upcoming buses to the bus-mounted terminal and the station terminal, respectively. After receiving the berth allocation information, the bus-mounted terminal and the station terminal perform voice prompts and dynamic display. At the same time, the intelligent control center updates the record chart of station berth state, and transmits the updated record chart to the station terminal for storage.

Figure 3:
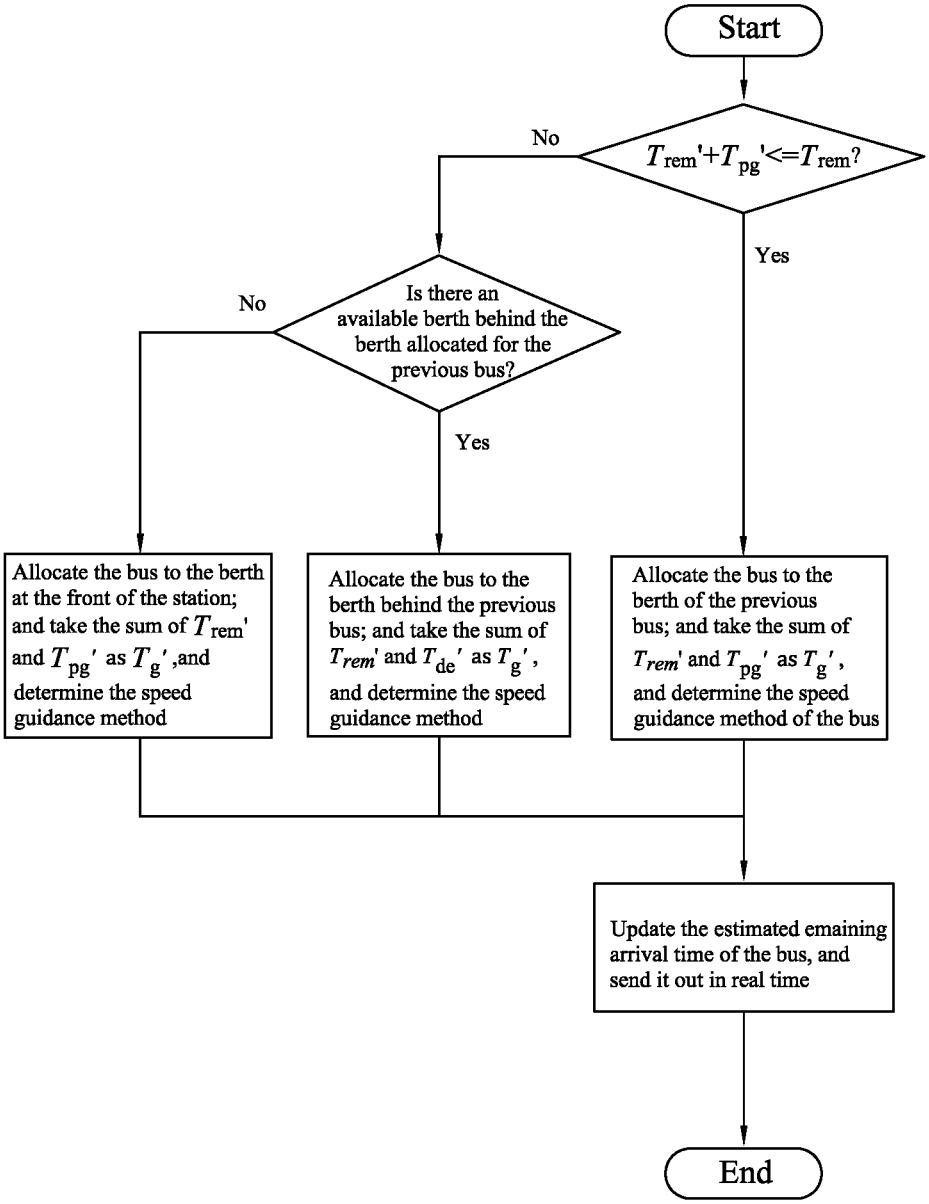
FIG. 3 is a flow chart of the guidance method and berth allocation of an upcoming bus that is not the first in the sequence of the upcoming buses according to an embodiment of the present disclosure.

FIG. 3 shows a flow chart of the guidance method and berth allocation of upcoming buses that are not the first in S6, where the allocated berth is any one of No. 1 berth, No. 2 berth, . . . , No. N berth, and the number of the allocated berth is no larger than the maximum number N of berths at the station. Specific steps are described as follows.

SS1: The bus-mounted terminal determines whether the sum of the estimated remaining arrival time $T_{rem}'$ of the previous upcoming bus and the total service time $T_{pg}'$ of the previous upcoming bus at the station is less than or equal to the estimated remaining arrival time $T_{rem}$ of the current upcoming bus; if yes, proceed to SS2; otherwise, proceed to SS3.

SS2: The intelligent control center allocates the current upcoming bus to the berth allocated for the previous upcoming bus; the sum of the estimated remaining arrival time $T_{rem}'$ of the previous upcoming bus and the total service time $T_{pg}'$ of the previous upcoming bus at the station is taken as the threshold guidance time $T_g$ of the current upcoming bus, so as to determine the speed guidance method of the current upcoming bus. Then, proceed to SS6.

SS3: The intelligent bus terminal further determines whether there is an available berth behind the berth allocated for the previous upcoming bus according to the pre-allocation state of the current station berth; if yes, proceed to SS4; otherwise, proceed to SS5.

SS4: The intelligent control center allocates the current upcoming bus to the berth behind the occupied berth of the previous bus. At the same time, the sum of the estimated remaining arrival time $T_{rem}'$ of the previous upcoming bus and the deceleration time $T_{de}'$ that the previous upcoming bus takes for stopping in the station as the threshold guidance time $T_g$ of the current upcoming bus, so as to determine the speed guidance for the current upcoming bus; and then proceed to SS6.

SSS5: The intelligent control center allocates the current upcoming bus to the No. 1 berth. At the same time, the sum of the estimated remaining arrival time $T_{rem}'$ of the previous upcoming bus and the total service time $T_{pg}'$ of the previous upcoming bus at the station is used as the threshold guidance time $T_g$ to determine the current bus-mounted speed guidance, and then proceed to SS6.

SS6: The estimated remaining arrival time $T_{rem}^*$ of the current upcoming bus is updated, and send it to the intelligent control center in real time.

Figure 2:
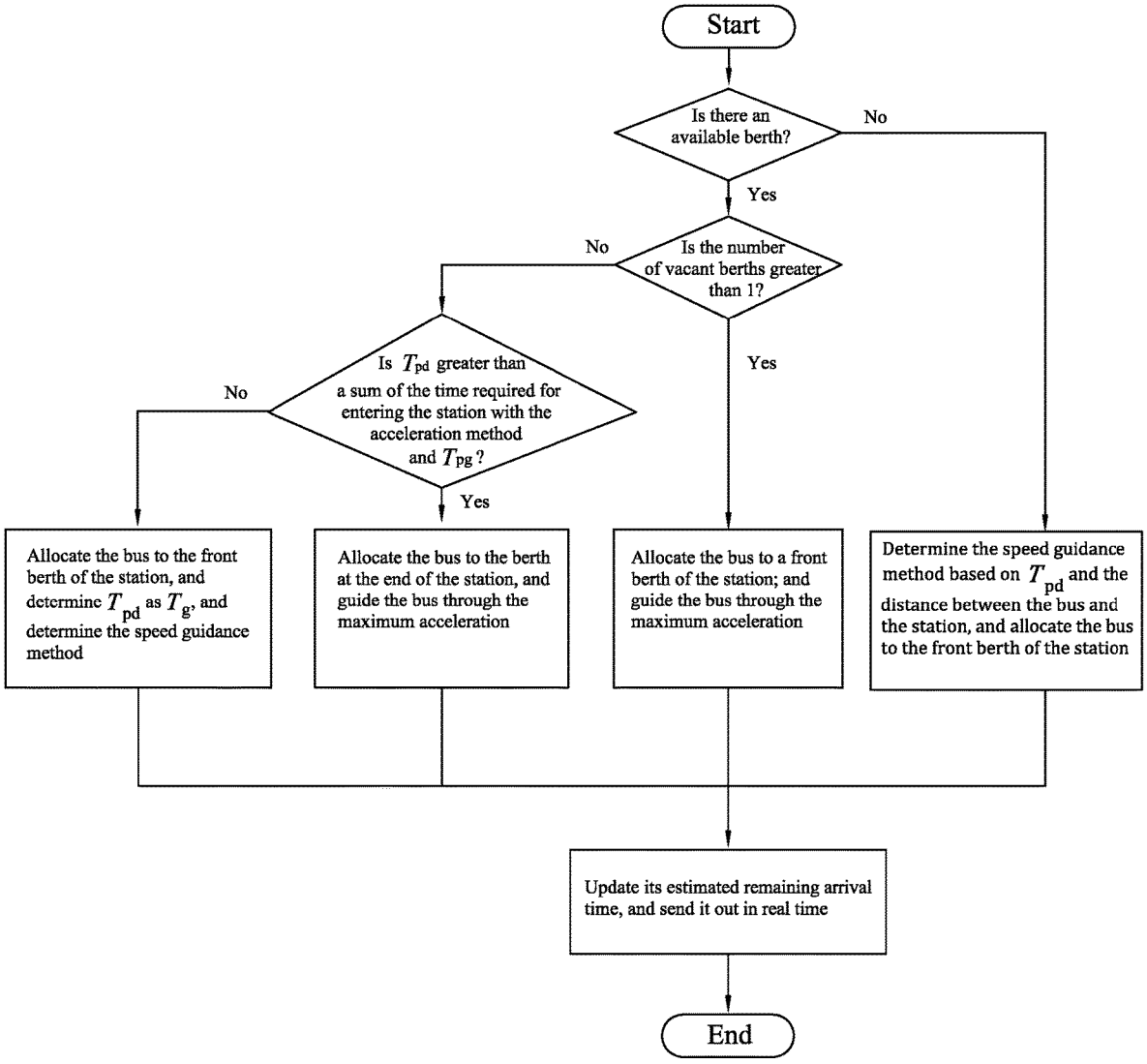
FIG. 2 is a flow chart of the guidance method and berth allocation of a first upcoming bus in the sequence of current upcoming buses according to an embodiment of the present disclosure.

FIG. 2 shows a flow chart of the guidance method and berth allocation of a first upcoming bus mentioned in S7, where the allocated berth is any one of the No. 1 berth, the No. 2 berth, . . . , the No. N berth, and the number of the allocated berth is no larger than the maximum number N of parking berths of the station. Specific steps are described as follows.

SSS1: The intelligent control center determines whether there is an available berth at the station; if not, proceed to SSS2; otherwise, proceed to SSS3.

SSS2: The bus-mounted terminal takes the remaining time of the parking service of the bus calculated by the parking time computational model of S3, that is, the remaining parking service time $T_{pd}$ of the parked bus as the threshold guidance time $T_g$ of the current upcoming bus. The bus-mounted terminal determines the speed guidance method to guide the speed of the current upcoming bus based on the distance of the current upcoming bus and the station. At the same time, the intelligent control center allocates the current upcoming bus to the No. 1 berth.

SSS3: The bus-mounted terminal determines whether the number of the available berths at the end of the station is greater than 1; if yes, proceed to SSS4; otherwise, proceed to SSS5.

SSS4: The intelligent control center allocates the current upcoming bus to the berth behind the last occupied berth, and sends the berth allocation information to the bus-mounted terminal; and the bus-mounted terminal performs the speed guidance for the driver in the shortest acceleration guidance method according to the berth allocation information. Then, proceed to SSS8.

SSS5: The intelligent control center determines whether the estimated total remaining time $T_{pd}$ of the parking service of the parked bus is greater than the sum of the threshold guidance time $T_g$ required for the current upcoming bus to arrive at the station with an accelerated guidance method and the estimated parking service time of the current upcoming bus at the station; if yes, proceed to SSS6; otherwise, proceed to SSS7.

SSS6: The intelligent control center allocates the current upcoming bus to the berth at the end of the station, and sends the allocation result to the bus-mounted terminal. The bus-mounted terminal performs the speed guidance for the driver in the shortest acceleration guidance according to the allocation result. Then, proceed to SSS8.

SSS7: The intelligent control center allocates the current upcoming bus to the No. 1 berth in the station, and sends the allocation result to the bus-mounted terminal. The estimated total remaining time $T_{pd}$ of parking service of the parked bus is used as the threshold guidance time $T_g$ of the current upcoming bus, so as to determine the speed guidance method of the current upcoming bus, and then proceed to SSS8.

SSS8: The guidance time $T_g$ of the current upcoming bus is updated to obtain the final estimated remaining arrival time $T_{rem}^*$ and sent out.

In S2, the data, obtained by the intelligent control center from the bus-mounted terminal of the upcoming bus, includes the current driving speed, driving direction, and current location information (longitude and latitude coordinates) of the bus. The bus station scene involved herein is a multi-berth station passing through a signalized intersection. Due to the signalized intersection, the distance between the upcoming bus and the station is divided into two parts for corresponding analysis:

$$S_i = S_{xi} + S_{zi}$$

where $S_i$ is the distance between the bus i and the station; the intelligent control center calculates the distance based on the location information of the bus-mounted terminal of the current upcoming bus, the location information of the bus station and the high-precision map; and $S_{xi}$ is the distance between the bus i and the signalized intersection; $S_{zi}$ is the distance between the bus i passing through the signalized intersection and the station; $S_{xi}$ and $S_{zi}$ are also calculated by the aforementioned method.

The estimated remaining arrival time of the upcoming bus without guidance is expressed as follow:

$$T_{rem(i)} = \begin{cases} \dfrac{(v_{de} - v_i)}{b_{max}} + \dfrac{\left[S_i - \dfrac{(v_{de}^2 - v_i^2)}{2b_{max}}\right]}{v_i} & t_{xi} = 0 \\ \dfrac{S_i}{v_i} + \dfrac{v_i}{2a_{max}} - \dfrac{v_i}{2b_{max}} + \dfrac{v_i - v_{de}}{b_{max}}\left(\dfrac{3}{2} + \dfrac{v_{de}}{v_i}\right) + t_{xi} & t_{xi} > 0 \end{cases},$$

where $T_{rem(i)}$ is the estimated remaining arrival time of the $i^{th}$ upcoming bus; $v_i$ is the current speed of the $i^{th}$ upcoming bus; $a_{max}$ and $b_{max}$ the maximum allowable acceleration/deceleration speed of the bus, respectively; $v_{de}$ is the speed when the bus is decelerated to enter the station; $t_{xi}$ is the waiting time of signal light. It should be noted that when the upcoming bus cannot pass the signalized intersection, the phase state of the signal light cannot be obtained from a distance, and can only be determined as the current upcoming bus approaches the signalized intersection, and then the bus is decelerated at the maximum allowable deceleration $b_{max}$ and stops to wait.

The waiting time of the signal light of the upcoming bus without being guided specifically expressed as:

$$t_{xi} = \begin{cases} r_i - \left[\mathrm{mod}\left(\dfrac{S_{xi}}{v_i} + \dfrac{v_i}{2b_{max}}, T_i\right) - T_i\right] & S_{xi} > 0 \text{ and } \mathrm{mod}\left(\dfrac{S_{xi}}{v_i}, T_i\right) > T_{gi} \\ 0 & \mathrm{mod}\left(\dfrac{S_{xi}}{v_i}, T_i\right) \le T_{gi} \text{ or } \mathrm{mod}\left(\dfrac{S_{xi}}{v_i}, T_i\right) \ge T_{ri} \text{ or } S_{xi} == 0 \\ T_{ri} - \mathrm{mod}\left(\dfrac{S_{xi}}{v_i} + \dfrac{v_i}{2b_{max}}, T_i\right) & S_{xi} > 0 \text{ and } \mathrm{mod}\left(\dfrac{S_{xi}}{v_i}, T_i\right) < T_{ri} \end{cases},$$

where $r_i$ is the cycle of red signal light; $g_i$ is the cycle of green signal light; $T_i$ is the cycle of the signal light (i.e., $r_i+g_i=T_i$); $T_{gi}$ is the countdown of current green signal light; $T_{ri}$ is the countdown of current red signal light; and mod(·) is the remainder function.

In S3, the buses arriving at the station follow the Poisson distribution; the parking time at the station follows the K-order Erlang distribution, and there are N berths at the station; a single-lane queuing system with multiple parking berths includes the traffic stream and the parking berths; and the parking time computational model of the bus is expressed as follows:

$$T_{pg} = x\frac{\rho^{N+1}p(0)}{\lambda(N-1)!(N-\rho)^2} + \left(xt_{start} + \frac{v_{de}}{a_{de}}\right) + \left(\frac{\Omega K t_0}{n_d} + t_{on+off}\right) + \frac{v_{ac}}{a_{ac}};$$

where $T_{pg}$ is the parking time of the bus; A is the average arrival rate of the buses within the station; ρ is the service intensity of the station; P(0) is the probability that there is no bus parking at the station; N is the number of parking berths at the station; $t_{start}$ is the time for the bus to start (preferably, $t_{start}$ is 2 s); $v_{de}$ is the deceleration of the bus when the bus enters the station: $a_{ac}$ is the acceleration of the bus when the bus enters; Ω is the bus capacity; K is the proportion of the number of passengers getting on and off the bus to the car capacity (preferably, K is 0.25-0.35; under normal situation, K is 0.25; during periods of high passenger flow, K is 0.35; $t_0$ is the time that each passenger takes to get on or get off the bus (preferably, $t_0$ is 2 s); $n_d$ is the number of car doors; $t_{on+off}$ is the total opening and closing time of car in the station (preferably, $t_{on+off}$ is 3.5 s); $v_{ac}$ is the average speed of the bus when the bus leaves the station; $a_{ac}$ is the acceleration of the bus when the bus leaves the station; and x represents the relationship between the number of buses entering the station and the number of vacant parking berths at the station at the same time, taking 0 or 1.

In S3, the buses are considered to enter the station through the speed guidance without stopping, so the parking service time of the parked buses and the upcoming buses do not include the waiting time outside the station and the start time after parking outside the station. Therefore, on the basis of the above-mentioned parking time computational model, the waiting time outside the station and the start time after parking outside the station are removed. The actual total parking service time of the parked bus and the upcoming bus mainly includes the deceleration time that the bus enters the station, the stop time and the accelerate time that the bus leaves the station. The specific calculation is expressed as:

$$T_{pd} = T_{pg} = \frac{v_{de}}{a_{de}} + \left(\frac{\Omega K t_0}{n_d} + t_{on+off}\right) + \frac{v_{ac}}{a_{ac}}.$$

When the first upcoming bus enters the guidance area, the parked bus has been served for a certain period of time. Therefore, the actual parking service time of the parked bus should be removed from the service time (i.e., $T_{pd}'=T_{pd}-T_{serve}$). Because the station is a linear station and overtaking is not allowed, the cars can only enter and leave the station in sequence. Therefore, the specific calculation of the total parking service time when there are multiple parked buses at the station is expressed as.

$$T_{pd}'=\max\{T_{pd}'(i)\}i=1,2,3,\ldots,N.$$

In SS4, the deceleration time when the bus enters the station is expressed as: $T_{de}'=v_{de}/a_{de}$, where the meaning of $v_{de}$ and $a_{de}$ is the same as the above.

In S6 and S7, the bus-mounted intelligent terminal guides the bus to move from the current position to the waiting area of the station within the threshold guidance time $T_g$, and the parking service time $T_{pg}$ of the bus from the waiting area to the station is calculated by the aforementioned parking time computational model.

In S6 and S7, there are three ways to perform the speed guidance for the buses within the threshold guidance time $T_g$, including the uniform deceleration guidance, the constant speed guidance and a uniform acceleration guidance.

The specific analysis process of the threshold value of the uniform deceleration guidance is described as follows.

Since the distance between the current position of the upcoming bus and the station is known, and the bus entering the waiting area needs to reach the speed threshold $v_{de}$ for entering the station through the deceleration, minimum deceleration guidance arrival time $T_{min\ de}$ that the bus needs from the current station to the station can be calculated according to the kinematic law. In this case, the bus will decelerate at a minimum deceleration $a_{min\ de}$ to move from the current position to the waiting area outside the station and reach the speed threshold $v_{de}$ for decelerating into the station. The specific calculation is expressed as follows.

$$a_{min\ de}=(v_{de}^2-v_i^2)/2S_i$$

$T_{min\ de}=(v_{de}-v_i)/a_{min\ de}$

For the deceleration guidance, the bus is decelerated at a maximum allowable deceleration $b_{max}$ to reach the speed threshold $v_{de}$ for decelerating into the station, and then the car keeps driving at a constant speed to the waiting area of the station. Therefore, the maximum deceleration guidance arrival time $T_{max\ de}$ required for the bus to decelerate into the station from the current station can be calculated according to the kinematic law. The specific calculation is expressed as:

$$T_{max\ de}=\frac{(v_{de}-v_i)}{b_{max}}+\left[S_i-\frac{(v_{de}^2-v_i^2)}{2b_{max}}\right]\Big/v_{de}.$$

If $T_{min\ de}\leq T_g\leq T_{max\ de}$, the bus uniformly decelerates firstly and then runs at a constant speed to arrive at the station. When $T_g>T_{max\ de}$, the first upcoming bus needs to stop to wait for a certain period of time at the waiting area and then enter the station smoothly.

The specific analysis process of the threshold value of the constant speed guidance is described as follows.

Since the distance between the current position of the upcoming bus and station is known, and the bus entering the waiting area needs to reach the speed threshold $v_{deceleration}$ for decelerating into the station, the bus can firstly be guided to a certain position at a constant speed and then the bus is decelerated at a maximum allowable deceleration $b_{max}$ to reach the speed threshold $v_{de}$ for decelerating into the station. In this case, the bus reaches the waiting area of the station. The time required for the process is the minimum constant speed guidance arrival time $T_{min\ cs}$. The process is similar to that of arrivals for the bus that has no guidance in the above calculation. The specific analysis is described as follows.

The time required for the deceleration process before the bus is about to arrive at the station is $T_B=(v_{de}-v_i)/b_{max}$, and the driving distance during this process is $S_B=(v_{de}^2-v_i^2)/b_{max}$. Since the time $T_A=(S_i-S_B)/v_i$ required for the constant speed process is known as described above, the total time required for this process is $T_{min\ cs}=(v_{de}-v_i)/b_{max}+[S_i-(v_{de}^2-v_i^2)/b_{max}]/v_i$.

If $T_{min\ de}<T_g\leq T_{min\ cs}$, the bus runs at a constant speed firstly and then decelerates to arrive at the station.

The specific analysis process of the threshold value of uniform accelerated guidance is described as follows.

Since the distance between the current position of the upcoming bus and station is known, and the bus entering the waiting area needs to reach the speed threshold $v_{de}$ for decelerating into the station, the bus firstly is accelerated at a maximum allowable acceleration $a_{max}$ to reach the speed limit $v_{max}$; then the bus uniformly runs at the speed limit; and finally the bus is decelerated at the maximum allowable deceleration $b_{max}$ to reach the speed threshold $v_{de}$ for decelerating into the station at the waiting area. The minimum guidance time of the bus in this case is $T_{min\ ac}$. The specific analysis is described as follows.

The time required for the deceleration process before the bus arrives at the station is $T_C=(v_{de}-v_{max})/b_{max}$, the driving distance of the decelerating process is $S_C=(v_{de}^2-v_{max}^2)/2b_{max}$, the time required for the uniform acceleration process is $T_A=(v_{max}-v_i)/a_{max}$, the driving distance of the accelerating process is $S_A=(v_{max}^2-v_i^2)/2a_{max}$, and the time required for the uniform speed process is $T_B=(S_i-S_A-S_C)/v_{max}$. Therefore, the minimum acceleration guidance arrival time $T_{min\ ac}$ is expressed as follow:

$$T_{min\ ac}=\frac{(v_{max}-v_i)}{a_{max}}+\frac{(v_{de}-v_{max})}{b_{max}}+\left[S_i-\frac{(v_{max}^2-v_i^2)}{2a_{max}}-\frac{(v_{de}^2-v_{max}^2)}{2b_{max}}\right]\Big/v_{max}$$

According to the analysis of the above formula, it can be obtained that the minimum actual threshold value of acceleration guidance is $T_{min\ ac}'=(v_{max}-v_i)/a_{max}+(v_{de}-v_{max})/b_{max}$, and the value acts as the actual acceleration guidance process only including the uniform acceleration process and the uniform deceleration process, and thus the threshold distance of acceleration guidance can be obtained, which is expressed as follow:

$$S_{min\ ac}'=(v_{max}^2-v_i^2)/2a_{max}+(v_{de}^2-v_{max}^2)/2b_{max}.$$

When $S_i>S_{min\ ac}'$ and $T_{min\ ac}'<T_g<T_{min\ cs}$, the bus is accelerated with the maximum allowable acceleration $a_{max}$ to the speed limit $v_{max}$, and then uniformly runs at the speed limit, and finally is uniformly decelerated to reach the station; when $S_i\leq S_{min\ ac}'$ and $T_g\leq T_{min\ ac}'$, the bus is accelerated in a uniform acceleration manner to v* and then is uniformly decelerated to reach the station.

In the S8, the judgment of whether the bus can pass through the intersection smoothly under the current threshold guidance time $T_g$ is specifically described as follow.

The speed guidance, such as uniform deceleration guidance, constant speed guidance and uniform acceleration guidance, is determined based on the obtained threshold guidance time $T_g$, and the time $T_{gs}$ for the bus to arrive at the signalized intersection from the current position is calculated under the determined speed guidance method. At the same time, the phase state of the signal light is obtained (i.e., the color of the signal light and the signal light countdown $T_{gi}/T_{ri}$). When mod $(T_{gs},T_i)\leq T_{gi}$ or mod $(T_{gs},T_i)\geq T_{ri}$, the bus is indicated to pass through the signalized intersection from the current position by the guidance method determined by the threshold guidance time $T_g$ within the current signal countdown. There is no need to adjust the threshold guidance time $T_g$ later, otherwise it needs to be updated and adjusted accordingly.

The specific calculation process of the uniform deceleration guidance is described as follows.

The guidance method is to decelerate first and then runs at a constant speed. The time of the uniform deceleration part is $T_1$, the average speed of the uniform deceleration part is $\overline{v_1}=(v_i+v_{de})/2$, the time of the constant speed part is $T_2$, and the distance between the bus i and the station is $S_i$. The relationship of these parameters is expressed as:

$$S_i=\overline{v_1}*T_1+v_{de}*T_2$$

$$T_g=T_1+T_2$$

$T_1$ and $T_2$ are calculated by the above formula, and the deceleration in the deceleration process can further be calculated by the formula $a_1=(v_{de}-v_i)/T_1$. Based on this, it can be calculated whether the bus can smoothly pass through the signalized intersection within the threshold guidance time. In the guidance method, the time $T_{gs}$ required for the bus to reach the signalized intersection from the current position needs to be discussed according to the situation. If $v_{de}*T_2\geq S_{zi}$, the deceleration phase of the speed guidance is completed before the intersection; at this time, $T_{gs}$ is expressed as $T_{gs}=T_1+(S_{xi}-\overline{v_1}T_1)/v_{de}$. If $v_{de}*T_2<S_{zi}$, the deceleration phase of the speed guidance is completed after passing through the signalized intersection; at this time, $T_{gs}$ is solved by the formula $v_it+\frac{1}{2}a_1t^2=S_{xi}$. Whether the bus can pass through the signalized intersection smoothly is determined by determining $\mathrm{mod}(T_{gs},T_i)$ and the signal light countdown.

The specific calculation process of the constant speed guidance is described as follows.

The guidance method is to allow the bus to run at a constant speed first and then decelerate. The time of the constant speed part is $T_1$, the time of uniform deceleration part is $T_2$, the average speed of the uniform deceleration part is $\overline{v_2}=(v_i+v_{de})/2$, and the total length of the guidance is $S_i$. The relationship of these parameters is expressed as:

$$S_i=v_i*T_1+\overline{v_2}*T_2;$$

$$T_g=T_1+T_2.$$

$T_1$ and $T_2$ are calculated by the above formula, and the deceleration in the deceleration process can further be calculated by the formula $a_2=(v_{de}-v_i)/T_2$. Based on this, it can be calculated whether the bus can smoothly pass through the signalized intersection within the threshold guidance time. In the guidance method, the time $T_{gs}$ required for the bus to reach the signalized intersection from the current position needs to be discussed according to the situation. If $v_i*T_1>S_{xi}$ is met, the uniform phase of the speed guidance has been completed after passing through the signalized intersection; at this time, $T_{gs}$ is expressed as $T_{gs}=S_{xi}/v_i$. If $v_i*T_1\leq S_{xi}$ is met, the uniform phase of the speed guidance has been completed before the intersection; at this time, $T_{gs}$ is solved by the formula $v_iT_1+v_it+\frac{1}{2}a_2t^2=S_{xi}$. Determine whether the bus can pass through the signalized intersection smoothly by determining $\mathrm{mod}(T_{gs},T_i)$ and the signal light countdown.

The specific calculation process of the uniform acceleration guidance is described as follows.

When $S_i>S_{min\ ac}'$ and $T_{min\ ac}'<T_g<T_{min\ cs}$, the guidance method is to allow the bus to accelerate first and then runs at a constant speed and finally decelerates. It is assumed that the bus is accelerated at the maximum allowable acceleration $a_{max}$ to the speed limit $v_{max}$ in the guidance method. The time of the uniform acceleration part is $T_1$, the average speed of the uniform acceleration part is $\overline{v_1}=(v_{max}+v_i)/2$, and $T_1=(v_{max}-v_i)/a_{max}$, the time of constant speed part is $T_2$, the time of the uniform deceleration part is $T_3$, the average speed of the uniform deceleration part is $\overline{v_3}=(v_{max}+v_{de})/2$ and the total guidance length is $S_i$. The relationship of these parameters is expressed as:

$$S_i=\overline{v_1}*T_1+v_{max}*T_2+\overline{v_3}*T_3$$

$$T_g=T_1+T_2+T_3$$

$T_1$, $T_2$ and $T_3$ are calculated by the above formula, and the deceleration in the deceleration process can further be calculated by the formula $a_3=(v_{de}-v_{max})/T_3$. With the guidance method, the time $T_g$, required for the bus to reach the signalized intersection from the current position needs to be discussed according to the situation. If $\overline{v_1}T_1\leq S_{xi}$, the acceleration phase of the speed guidance is completed before the signalized intersection; at this time, $T_{gs}$ is expressed as $T_g$, $=T_1+(S_{xi}-\overline{v_1}T_l)/v_{max}$. If $\overline{v_1}T_1+v_{max}T_2\leq S_{xi}$, the acceleration phase and constant speed phase of the speed guidance are completed before the intersection; at this time, $T_{gs}$ is solved by the formula $\overline{v_1}T_1+v_{max}T_2+v_{max}t+\frac{1}{2}a_3t^2=S_{xi}$. If $\overline{v_1}T_1>S_{xi}$, the acceleration phase of the speed guidance is completed after passing through the signalized intersection; at this time, $T_{gs}$ is solved by the formula $v_it+\frac{1}{2}a_{max}t^2=S_{xi}$. Whether the bus can pass through the signalized intersection smoothly is determined by determining $\mathrm{mod}(T_{gs},T_i)$ and the signal light countdown.

In addition, when $S_i\leq S_{min\ ac}$ and $T_g\leq T_{min\ ac}$, the guidance method is to accelerate first to $v_i*$ and then decelerate. The time of the uniform acceleration part is $T_1$, the average speed of the uniform acceleration part is $\overline{v_1}=(v_i*+v_i)/2$, the time of the constant speed part is $T_2$, the average speed of the uniform deceleration part is $\overline{v_2}=(v_i*+v_{de})/2$, and the total guidance length is $S_i$. The relationship of these parameters is expressed as:

$$S_i=\overline{v_1}*T_1+\overline{v_2}*T_2$$

$$T_g=T_1+T_2,$$

$T_1$ and $T_2$ are calculated by the above formula, and the acceleration/deceleration in the acceleration/deceleration process can further be calculated by the formulas $a_1=(v_i*-v_i)/T_1$ and $a_2=(v_{de}-v_i*)/T_2$. With the guidance method, the time $T_{gs}$ required for the bus to reach the signalized intersection from the current position needs to be discussed according to the situation. If $\overline{v_1}T_1\leq S_{xi}$, the acceleration phase of the speed guidance is completed before the intersection; at this time, $T_{gs}$ is expressed as $T_g$, $=T_1+(S_{xi}-\overline{v_1}T_1)/v_{max}$. If $\overline{v_1}T_1>S_{xi}$, the acceleration phase of the speed guidance is completed after passing through the signalized intersection; at this time, $T_{gs}$ is solved by the formula $v_it+\frac{1}{2}a_1t^2=S_{xi}$. Whether the bus can pass through the signalized intersection smoothly is determined by determining $\mathrm{mod}(T_{gs},T_i)$ and the signal light countdown.

If the bus cannot pass through the signalized intersection under the current guidance method, the guidance method of the upcoming bus needs to be adjusted so that the bus can smoothly pass the signalized intersection without stopping under the current signal light phase state. First, it is necessary to consider the delay time $T_d$ caused affected by the signal light under the current guidance method. There are mainly two situations when the buses cannot pass through the signalized intersection under the guidance method.

1) If $\mathrm{mod}(T_{gs},T_i)>T_{gi}$, the bus cannot pass through the signalized intersection under the countdown of the current green signal light, and the delay time $T_d=r_i-[\mathrm{mod}(T_{gs},T_i)-T_{gi}]$ is caused.

2) If $\mathrm{mod}(T_{gs},T_i)<T_{ri}$, the bus cannot pass through the signalized intersection under the countdown of the current red signal light, and the delay time $T_d=T_{ri}-\mathrm{mod}(T_{gs},T_i)$ is caused.

Therefore, in order to ensure that the bus passes through the signalized intersection without stopping, the actual time to reach the signalized intersection should be expressed as $T_{gs}'=T_{gs}+T_d$. The guidance method for buses arriving at the signalized intersection in this case is analyzed as follows.

The speed of the bus at the signalized intersection is supposed as $v_i*$, and the bus arrives at the signalized intersection from the current position at a motion state of uniform variable speed/constant speed. Therefore, the average speed of the bus within $S_{xi}$ is expressed as $\overline{v}_i*=(v_i+v_i*)$, and then $v_i*$ can be solved by the equation $\overline{v}_i*T_{gs}'=S_{xi}$. The value $v_i*$ is analyzed to determine the actual guidance method. If $v_i*>v_i$, the actual guidance method is a uniform acceleration guidance method and its acceleration is expressed as $a_i*=(v_i*-v_i)/T_{gs}'$; if $v_i*=v_i$, the actual guidance method is the uniform guidance method; if $v_i*<v_i$, the actual guidance method is the uniform deceleration guidance method and its deceleration is expressed as $b_i*=(v_i*-v_i)/T_{gs}'$. According to the kinematic law, the minimum deceleration time is expressed as $b_{min}*=-v_i^2/2S_{xi}$, the time required is the threshold time for the bus to decelerate to zero, which is expressed as $$t_{max}*=-\frac{v_i}{b_{min}}*.$$

If $T_{gs}'>t_{max}*$, the bus is guided with the uniform deceleration method to arrive at the signalized intersection, and its deceleration is $b_{min}*$, and the bus needs to wait for a period time at the signalized intersection, and the waiting time is expressed as $T_w'=T_{gs}'-t_{max}*$.

Thereafter, the previous guidance method is updated to make the bus pass through the signalized intersection, thereby causing the subsequent guidance method changes accordingly. The specific changes are described as follows.

(1) When the bus arrives at the signalized intersection with the deceleration guidance method and does not wait at the intersection, after passing through the intersection, the bus is accelerated at the maximum allowable acceleration $a_{max}$ to $v_i$, and decelerated at maximum allowable deceleration $b_{max}$ to $v_{de}$ to reach the waiting area after running at $v_i$ for $t_a$. The relationship of these parameters is expressed as:

$$v_i t_a = S_{zi} - \frac{v_i^2-(v_i^*)^2}{2a_{max}} - \frac{v_{de}^2-v_i^2}{2b_{max}}.$$

According to the above formula given, the time $t_a$ the bus takes to travel at the constant speed after passing through the intersection is obtained, and then the actual total guidance time after updating the guidance method is obtained, which is expressed as:

$$T_g*=T_{gs}'+(v_i-v_i*)/a_{max}+t_a+(v_{de}-v_i)/b_{max}.$$

(2) The bus arrives at the signalized intersection with the constant method for speed guidance. After passing through the intersection, the bus is decelerated at maximum allowable deceleration $b_{max}$ to $v_{de}$ to reach the waiting area after running at $v_i$ for $t_a$. The relationship of these parameters is expressed as:

$$v_i t_a = S_{zi} - \frac{v_{de}^2-v_i^2}{2b_{max}}.$$

According to the above formula given, the time $t_a$ the bus takes to travel at the constant speed after passing through the intersection is obtained, and then the actual total guidance time after updating the guidance method is obtained, which is expressed as:

$$T_g*=T_{gs}'+t_a+(v_{de}-v_i)/b_{max}.$$

(3) The bus arrives at the signalized intersection with the acceleration guidance method. After passing through the intersection, the bus is decelerated at maximum allowable deceleration $b_{max}$ to $v_{de}$ to reach the waiting area after running at $v_i*$ for $t_a$. The relationship of these parameters is expressed as:

$$v_i^* t_a = S_{zi} - \frac{v_{de}^2-(v_i^*)^2}{2b_{max}}.$$

According to the above formula given, the time $t_a$ the bus takes to travel at the constant speed after passing through the intersection is obtained, and then the actual total guidance time after updating the guidance method is obtained, which is expressed as:

$$T_g*=T_{gs}'+t_a+(v_{de}-v_i*)/b_{max}.$$

(4) The bus arrives at the signalized intersection with the deceleration guidance method and waits at the intersection. After passing through the intersection, the bus is accelerated at the maximum allowable acceleration $a_{max}$ to $v_i$, and decelerated at maximum allowable deceleration $b_{max}$ to $v_{de}$ to reach the waiting area after running at $v_i$ for $t_a$. The relationship of these parameters is expressed as:

$$v_i t_a = S_{zi} - \frac{v_i^2}{2a_{max}} - \frac{v_{de}^2-v_i^2}{2b_{max}}.$$

According to the above formula given, the time $t_a$ the bus takes to travel at the constant speed after passing through the intersection is obtained, and then the actual total guidance time after updating the guidance method is obtained, which is expressed as:

$$T_g*=T_{gs}'+v_i/a_{max}+t_a+(v_{de}-v_i)/b_{max}.$$

The guidance time $T_g/T_g*$ of the bus determined in the S6, S7 and S13 will be used as the estimated remaining arrival time $T_{rem}*$ of the guided bus after performing the speed guidance.

In S20, the change of the current guidance environment mainly includes the random change of the station berths after the speed guidance is performed under the current determination sequence of the BusNumber buses. For example, the actual parking service time of the bus at the station is shorter than the estimated time, and the bus leaves the station in advance; the actual parking time of the bus at the station is longer than the estimated time; or there are new upcoming buses to enter the station. These changes will have a certain impact on the sequence and guidance time of the BusNumber buses, so S1 is returned to regenerate a new sequence and a new speed guidance method of the buses in the BusNumber table.

In S2, the formation of the sequence of the BusNumber buses is mainly considered from the following two aspects. When the system is initialized, the intelligent control center mainly calculating the estimated remaining arrival time $T_{rem}$ of the upcoming buses without guidance, and sort the time to form the BusNumber table. When a new upcoming bus is added to the sequence, the estimated remaining arrival time $T_{rem}$ of the newly added bus without guidance and the estimated remaining arrival time $T_{rem}'$ of the guided bus are comprehensively sorted, and the system process is performed to form a new sequence in the BusNumber table.

The BusNumber table records the relevant information of each upcoming bus, including the ID number, the line number, longitude and latitude coordinate, remaining distance to the station, the estimated remaining arrival time, estimated parking service time at the station, driving speed, driving direction marker, arrived parked marker, departure marker, current queuing sequence number and allocated berth of the upcoming bus. The record table of the berths state records the relevant information about the occupancy of each berth at the station, including the ID number of the first allocated pre-parked bus, the ID number of the next allocated pre-parked bus, and the occupancy marker of the berth.

Figure 4:
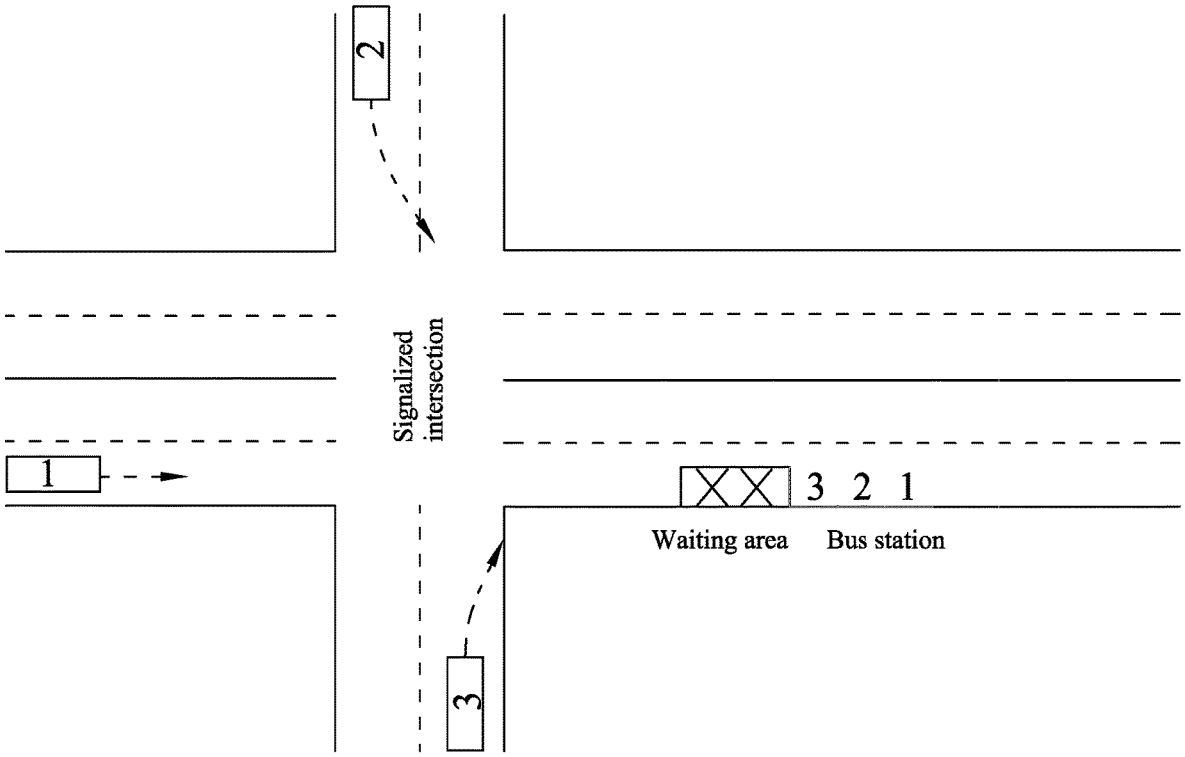
FIG. 4 is a schematic diagram of the multiline bus station according to an embodiment of the present disclosure.

As shown in FIG. 4, the implementation process of the method for berth allocation of the multiline bus station and speed guidance of buses is illustrated by a specific example.

Assuming that there are three parking berths at a bus station, including the No. 1 berth, the No. 2 berth and the No. 3 berth, where No. 1 berth is at the forefront of the station. At this moment, there are buses parked in the No. 1 berth and the No. 2 berth in the station, and No. 3 berth are vacant. At the same time, three buses, including the No. 1 bus, the No. 2 bus and the No. 3 bus, from different directions will stop at the station. Because of the use of parking berths and the randomness of upcoming buses, the implementation process of dynamic berth allocation and the guidance method of speed can be briefly explained by only one of the above assumptions used as a prerequisite, and the buses are not allowable to overtake at the station.

The intelligent control center first receives real-time traffic information from the bus-mounted positioning modules installed on the bus-mounted terminal of the three buses through the wireless communication module, and then stores and processes the received information, and calculates the estimated remaining arrival time $T_{rem}(i)$ of the three upcoming buses without guidance, and the estimated remaining arrival time $T_{rem}(i)$ of the three upcoming buses are sorted according to the time to form the initial BusNumber table. The record table of the upcoming buses is obtained by the initial sorting, in which the No. 1 bus is the current first upcoming bus, the No. 2 bus is the current second upcoming bus and the No. 3 bus is the current third upcoming bus. After that, the intelligent control center uses the parking time computational model and combines the service time of the parked bus to obtain the total remaining service time $T_{pd}$ of the parked bus and the parking service time $T_{pg}(i)$ of the three upcoming buses. Then, the intelligent control center makes corresponding judgments on the three buses according to the order of the existing buses in the BusNumber table.

First, the No. 1 bus is determined based on the estimated remaining arrival time $T_{rem}(1)$ of the No. 1 bus without guidance and the distance between the bus and the station, and combined with the current berth state of the station. At this time, there is a vacant berth at the end of the station. It is assumed that the total remaining service time $T_{pd}$ of the parked bus at the station is determined to be less than the guidance time $T_{min\ ac}$ of the No. 1 bus in the acceleration guidance method with the shortest guidance time and the parking service time $T_{pg}$ at the station, which indicates that compared with the delay time caused by the bus accelerated to enter the station and then leaving the station after being served, the delay time caused by the bus waiting for the parked buses to be emptied at the station before entering the station is smaller for the subsequent bus. Therefore, the intelligent control center chooses to allocate the No. 1 bus to the No. 1 berth located at the front of the station; the actual guidance time $T_g(1)$ to enter the station is the total remaining service time $T_{pd}(1)$ of the parked bus at the station, which is regarded as the final estimated remaining arrival time $T_{rem}'(1)$ of the No. 1 bus, and is sent out in real time. The final guidance method of the No. 1 bus will be determined according to the relationship between the threshold value of each guidance method and $T_g$. It is assumed that the final guidance method is the constant speed guidance method, and it is determined that the bus can pass through the signalized intersection under the speed guidance method, so it is further determined that the No. 1 bus is not the last bus in BusNumber table. Then, the No. 2 bus in the BusNumber table is determined.

The speed guidance method of the No. 2 bus is determined based on the final estimated remaining arrival time $T_{rem}'(1)$ sent by the No. 1 bus in real time, the distance between the No. 2 bus and the station and the berth allocation situation of the station at this time. It has been determined that the No. 1 bus has been allocated to No. 1 berth. At this time, it is further determined that the sum of the estimated remaining arrival time $T_{rem}'(1)$ and the parking service time $T_{pg}'(1)$ of the bus ahead (No. 1 bus) is greater than the estimated remaining arrival time $T_{rem}(2)$ of the No. 2 bus without guidance. Therefore, the sum of the estimated remaining arrival time of the No. 1 bus and the time that the bus decelerates to enter the station is regarded as the arrival guidance time of the No. 2 bus. Given the above, the corresponding speed guidance method of the No. 2 bus is determined. At this time, the No. 1 berth is allocated and there are still available berths behind the No. 1 berth, so the No. 2 bus is allocated to the No. 2 berth. However, it is further determined to know that the No. 2 bus cannot pass through the signalized intersection smoothly under the currently determined guidance method, and the delay time caused by the impact of signal lights is further obtained. Finally, the updated final guidance arrival time $T_g^*(2)$ of the No. 2 bus is obtained based the delay. The No. 2 bus is not in the same direction as the No. 1 bus according to the position of the No. 2 bus, and then $T_g^*(2)$ and the estimated remaining arrival time $T_{rem}(3)$ of the next vehicle (the No. 3 bus) without guidance. $T_g^*(2)>T_{rem}(3)$, which indicates that the delay time caused by the No. 2 bus with the current guidance method is greater than the time required for the No. 3 bus to arrive at the station. Therefore, it is necessary to exchange the sequence numbers of the No. 2 bus and the No. 3 bus in BusNumber table, that is, the current No. 2 bus is changed as the No. 3 bus, and the current No. 3 bus is changed as the No. 2 bus. Then, a new round of judgment is restarted based on the updated BusNumber table.

At this time, because the estimated remaining arrival time of the No. 1 bus is the original value, the judgment process thereof is the same as the foregoing, and the No. 1 bus maintains the original guidance time $T_g(1)$ and the guidance method under this guidance time, and the No. 1 bus is allocated to the No. 1 berth in the front of the station. Since the original No. 3 bus has been changed as the No. 2 bus, its estimated remaining arrival time should be expressed as $T_{rem}(2)_{new}=T_{rem}(3)$. It is further determined that the sum of the estimated remaining arrival time $T_{rem}'(1)$ and the service time $T_{pg}'(1)$ of the No. 1 bus is greater than the estimated remaining arrival time $T_{rem}(2)_{new}$ of No. 2 bus, and then the estimated remaining arrival time $T_{rem}'(1)$ of the No. 1 bus and the time $T_{de}'(1)$ that the bus decelerates to enter the station are regarded as the arrival guidance time $T_{rem}(2)_{new}$ of the current No. 2 bus. The guidance method of the current No. 2 bus is determined based on the guide arrival time. The intelligent control center allocates the current No. 2 bus to the No. 2 berth. Since the current No. 2 bus turns right to the station, so it is not affected by the signal light, and the current No. 2 bus can pass through the signalized intersection smoothly. Then it is further determined that the No. 1 bus is not the last bus in BusNumber table. Then the No. 3 bus in the BusNumber table is determined.

For the current No. 3 bus, its estimated remaining arrival time should be $T_{rem}(3)_{new}=T_{rem}(2)$. It is further determined that the sum of the estimated remaining arrival time $T_{rem}'(2)$ of the No. 2 bus and the service time $T_{pg}'(2)$ at the station is less than the estimated remaining arrival time $T_{rem}(3)_{new}$ of the current No. 3 bus. The sum of $T_{rem}'(2)$ and $T_{pg}'(2)$ is regarded as the guide arrival time $T_g(3)_{new}$ of the current No.

3 bus. The intelligent control center will allocate the current No. 3 bus to the same berth as the current No. 2 bus, i.e., the current No. 3 bus is the next pre-parking bus parked in the No. 2 berth. Furthermore, it is determined that the current No. 3 bus can pass through the signalized intersection smoothly with the current guidance method, and then it is determined that the last bus in the BusNumber table is the current No. 3 bus. Therefore, the sequence of the BusNumber table is finally determined, in which each bus conducts the guidance operation in accordance with the previously determined guidance time and guidance method. The intelligent control center sends the final berth allocation results of the upcoming buses and their estimated remaining arrival time to the station terminal. The station terminal induces the passengers through the combination of LED electronic display and voice broadcast after data analysis and processing, and informs the estimated remaining arrival time of buses on each line.

What is claimed is:

1. A method for berth allocation of a multiline bus station and speed guidance of buses, comprising:

S1: ranking estimated remaining arrival time of buses between a current station and a previous station in an ascending order to form a BusNumber table;

S2: conducting speed guidance for a current upcoming bus in the BusNumber table through a bus-mounted terminal, and an allocating berth for the current upcoming bus through an intelligent control center;

S3: determining whether the current upcoming bus is allowed to pass through a signalized intersection; if yes, proceeding to S4; otherwise, proceeding to S5;

S4: conducting the speed guidance of the step 2 for the current upcoming bus; maintaining the bus sequence in the BusNumber table through the intelligent control center; and allocating the berth determined in step 2 for the current upcoming bus; and then proceeding to S11;

S5: determining whether a sequence number of the current upcoming bus is the first in the BusNumber table and whether the current upcoming bus is able to pass through the signalized intersection through acceleration; if yes, proceeding to S6; otherwise, proceeding to S7;

S6: after the current upcoming bus accelerates to pass through the signalized intersection, guiding the current upcoming bus to enter a waiting area of the multiline bus station with a fixed guidance method, and allocating the berth determined in the step 2 for the current upcoming bus; and proceeding to S11;

S7: updating, by the bus-mounted terminal of the current upcoming bus, the speed guidance to allow the current upcoming bus to pass through the signalized intersection without stopping; and then determining the speed guidance after passing through the signalized intersection; and proceeding to S8;

S8: determining whether estimated remaining arrival time of the current upcoming bus is greater than that of a subsequent bus in the BusNumber table and whether the current upcoming bus and the subsequent bus in the BusNumber table are in the same direction; if yes, proceeding to S9; otherwise, proceeding to S10;

S9: exchanging the sequence of the current upcoming bus and the subsequent bus in the BusNumber table to update the BusNumber table; and then proceeding to S2;

S10: based on the updated speed guidance in the step 7 and current berth occupancy information, reallocating the berth for the current upcoming bus; and then proceeding to S11;

S11: determining whether the sequence of the current upcoming bus is at the end of the BusNumber table; if yes, proceeding to S12; otherwise, determining the sequence of the subsequent bus following the current upcoming bus in the BusNumber table, and then proceeding to S2; and S12: determining the sequence of the buses in the BusNumber table, and guiding actual speeds of the buses based on the speed guidance in the BusNumber table.

2. The method of claim 1, wherein the step 2 comprises:

determining whether the sequence number of the current upcoming bus is the first in the BusNumber table;

if yes, conducting the speed guidance for the current upcoming bus based on the berth occupancy state and the distance between the current upcoming bus and the multiline bus station received by the bus-mounted terminal, and allocating the berth for the current upcoming bus by the intelligent control center; and then proceeding to S3;

otherwise, conducting the speed guidance for the current upcoming bus based on threshold guidance time of the current upcoming bus, berth allocation information and the distance between the current upcoming bus and the station, and allocating the berth for the current upcoming bus by the intelligent control center; and then proceeding to S3.

3. The method of claim 2, wherein if the sequence number of the current upcoming bus is not the first in the BusNumber table, the step 2 comprises:

SS1: determining whether a sum of estimated remaining arrival time $T_{rem}'$ of a previous upcoming bus and total service time $T_{pg}'$ of the previous upcoming bus is less than or equal to the estimated remaining arrival time $T_{rem}$ of the current upcoming bus; if yes, proceeding to SS2; otherwise, proceeding to SS3;

SS2: allocating the current upcoming bus to the berth allocated for the previous upcoming bus by the intelligent control center; taking the sum of the estimated remaining arrival time $T_{rem}'$ of the previous upcoming bus and the total service time $T_{pg}'$ of the previous upcoming bus at the multiline bus station as the threshold guidance time $T_g$ of the current upcoming bus, so as to determine the speed guidance of the current upcoming bus; and then proceeding to SS6;

SS3: determining, by the bus-mounted terminal, whether there is an available berth behind the berth allocated for the previous upcoming bus; if yes, proceeding to SS4; otherwise, proceeding to SS5;

SS4: allocating, by the intelligent control center, the berth behind the berth allocated for the previous upcoming bus for the current upcoming bus; taking the sum of the estimated remaining arrival time $T_{rem}'$ of the previous upcoming bus and deceleration time $T_{de}'$ that the previous upcoming bus takes for stopping in the multiline bus station as the threshold guidance time $T_g$, so as to determine the speed guidance of the current upcoming bus; and then proceeding to SS6;

SS5: allocating the current upcoming bus to No. 1 berth by the intelligent control center; taking the sum of the estimated remaining arrival time $T_{rem}'$ of the previous upcoming bus and the total service time $T_{pg}'$ of the previous upcoming bus as the threshold guidance time $T_g$, so as to determine the speed guidance of the current bus-mounted terminal; and then proceeding to SS6; and SS6: updating the estimated remaining arrival time $T_{rem}$ of the current upcoming bus to obtain updated estimated remaining arrival time $T_{rem}$*, and sending it to the intelligent control center in real time.

4. The method of claim 2, wherein if the sequence number of the current upcoming bus is the first in the BusNumber table, the method comprises:

SSS1: determining, by the intelligent control center, whether there is an available berth at the multiline bus station; if yes, proceeding to SSS3; otherwise, proceeding to SSS2;

SSS2: taking parking service time $T_{pd}$ of a parked bus as the threshold guidance time $T_g$ of the current upcoming bus; determining the speed guidance of the current upcoming bus based on the distance between the current upcoming bus and the multiline bus station; at the same time, allocating the current upcoming bus to No. 1 berth by the intelligent control center; and proceeding to SSS8;

SSS3: determining, by the bus-mounted terminal, whether the number of the available berth of the multiline bus station is greater than 1; if yes, proceeding to SSS4; otherwise, proceeding to SSS5;

SSS4: allocating, by the intelligent control center, the current upcoming bus to the berth behind a last occupied berth, and sending allocation information to the bus-mounted terminal; and selecting, by the bus-mounted terminal, a quickest acceleration guidance method to guide a speed of the current upcoming bus according to the allocation information; and then proceeding to SSS8;

SSS5: determining, by the intelligent control center, whether the parking service time $T_{pd}$ of the parked bus is greater than the sum of the threshold guidance time $T_g$ required for the current upcoming bus to arrive at the multiline bus station with an accelerated guidance and estimated parking service time $T_{pg}$ of the current upcoming bus at the multiline bus station; if yes, proceeding to SSS6; otherwise, proceeding to SSS7;

SSS6: allocating, by the intelligent control center, the current upcoming bus to the berth at the end of the station; and sending the allocation information to the bus-mounted terminal; selecting the quickest acceleration guidance method to guide the speed of the current upcoming bus according to the allocation information, and proceeding to SSS8;

SSS7: allocating, by the intelligent control center, the current upcoming bus to the No. 1 berth in the multiline bus station, and sending the allocation information to the bus-mounted terminal; taking the parking service time $T_{pd}$ of the parked bus as the threshold guidance time $T_g$ of the current upcoming bus, so as to determine the speed guidance of the current upcoming bus; and then proceeding to SSS8; and SSS8: updating the estimated remaining arrival time $T_{rem}$ of the current upcoming bus to obtain updated estimated remaining arrival time $T_{rem}$* of the current upcoming bus and sending it to the intelligent control center.

5. The method of claim 1, wherein the step 3 comprises:

determining the speed guidance of the current upcoming bus is uniform deceleration guidance, uniform speed guidance or uniform acceleration guidance according to the speed guidance determined in the step 2; and calculating the time $T_g$ that the current upcoming bus takes from the current position to the signalized intersection; and at the same time, obtaining, by the intelligent control center, a phase state of a signal light of the signalized intersection;

if the mod $(T_{gs},T_i)\leq T_{gi}$ or mod $(T_{gs},T_i)\geq T_{ri}$, enabling the current upcoming bus to pass the signalized intersection from the current position within a countdown of a signal light according to the speed guidance determined in the step 2, wherein $T_{gi}$ is the countdown of a current green light of a signal light; $T_{ri}$ is the countdown of a current red light of the signal light; $T_i$ is the total cycle of the signal light; $r_i+g_i=T_{gi}$; wherein $r_i$ is the cycle of the red light of the signal light, and $g_i$ is the cycle of the green light of the signal light.

6. The method of claim 5, wherein in the step 3, in the case that the speed guidance determined the step 2 fails to guide the current upcoming bus to pass the signalized intersection, 1) If mod $(T_{gs},T_i)>T_{gi}$, the current upcoming bus fails to pass the signalized intersection within the countdown of the current green light of the light signal, and delay time $T_d=r_i-[\text{mod}(T_{gs},T_i)-T_{gi}]$, wherein the delay time $T_d$ is caused by the signal light; and 2) if mod $(T_{gs},T_i)<T_{ri}$, the current upcoming bus fails to pass the signalized intersection within the countdown of the current red light of the light signal, and the delay time $T_d=T_{ri}-\text{mod}(T_{gs},T_i)$ is caused.

7. The method of claim 6, wherein in the step 7, when the current upcoming bus passes the signalized intersection without stopping, time $T_{gs}$ that the current upcoming bus needs to take from the current position to the signalized intersection is updated to an actual time $T_{gs}'$ that the current upcoming bus takes from the current position to the signalized intersection; and $T_{gs}'=T_{gs}+T_d$, wherein $T_d$ is the delay time caused by the signal light.

8. The method of claim 1, further comprising:

S13: determining whether the current guidance environment is changed; if yes, returning to the step 1; otherwise, proceeding to S14;

S14: maintaining the current guidance to guide the speed of all buses in the BusNumber table, deleting the bus that has been guided from the BusNumber table; and enabling the sequence of unguided buses to move forward one by one; and proceeding to S15; and S15: determining, by the intelligent control center, whether all buses in the BusNumber table have been guided, if yes, completing the speed guidance for all upcoming buses within a current detectable range; otherwise, returning to the step 12 to perform the speed guidance for the remaining buses in the BusNumber table.

9. The method of claim 1, further comprising:

S16: sending, by the intelligent control center, the berth allocation information to the bus-mounted terminal and a station terminal;

performing a voice prompt and dynamic display after the bus-mounted terminal and the station terminal receive the berth allocation information; and updating, by the intelligent control center, berth state information of the station, and transmitting the berth state information of the multiline bus station to the station terminal.

* * * * *